United States Patent [19]

Jeffrey et al.

[11] 4,002,036

[45] Jan. 11, 1977

[54] MINE ROOF SUPPORTS

[75] Inventors: Ian Campbell Jeffrey, Parbold; James Gray Stevenson, Wigan, both of England

[73] Assignee: Gullick Dobson Limited, Wigan, England

[22] Filed: May 9, 1975

[21] Appl. No.: 575,960

[30] Foreign Application Priority Data

June 4, 1974 United Kingdom ..... 24633/74

[52] U.S. Cl. ..... 61/45 D

[51] Int. Cl.[2] ..... E21D 15/44

[58] Field of Search ..... 61/45 D; 248/357; 299/31, 33; 91/170 MP

[56] References Cited

UNITED STATES PATENTS

| | | | |
|---|---|---|---|
| 3,115,754 | 12/1963 | Joseph | 61/45 D |
| 3,523,424 | 8/1970 | Allen | 61/45 D |
| 3,739,586 | 6/1973 | Wehner et al. | 61/45 D |
| 3,837,170 | 9/1974 | Martinko et al. | 61/45 D |
| 3,889,475 | 6/1975 | Allen | 61/45 D |
| 3,903,703 | 9/1975 | Lubojatsky | 61/45 D |

*Primary Examiner*—Dennis L. Taylor

*Attorney, Agent, or Firm*—Berman, Aisenberg & Platt

[57] ABSTRACT

A mine roof support of the type having a canopy supported from a base structure by hydraulically extensible legs and a cantilever roof-engaging member pivotally attached to the forward end of the canopy, is provided with a selectively positionable laterally extending cantilever member by means of which the effective roof-engaging surface of the canopy can be extended, the lateral cantilever member being optionally provided with a forwardly projecting cantilever member by means of which the effective width of the roof-engaging member can also be extended.

9 Claims, 8 Drawing Figures

-FIG.1-

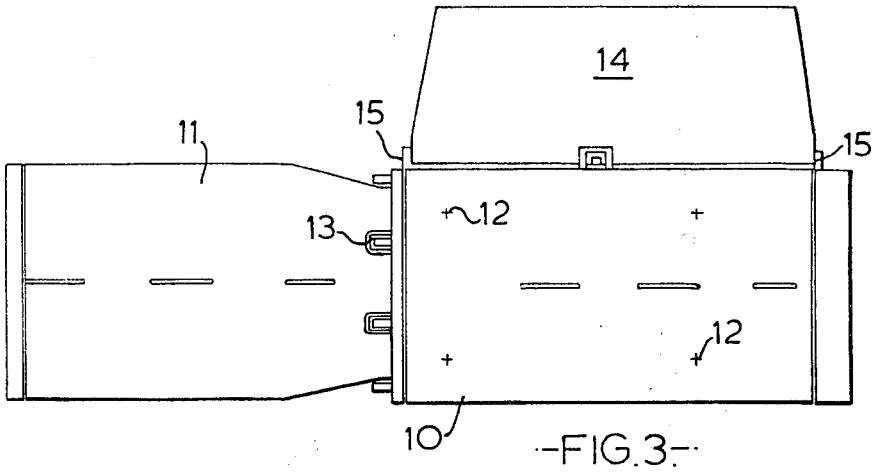
-FIG.3-
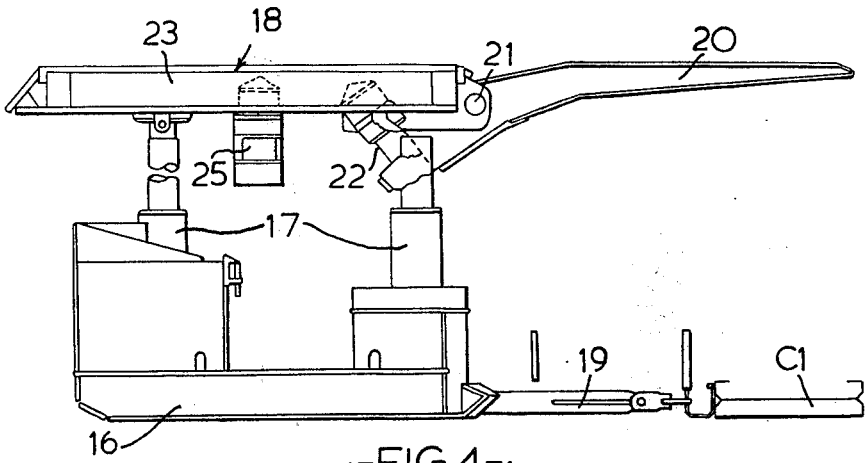
-FIG.4-
-FIG.5-
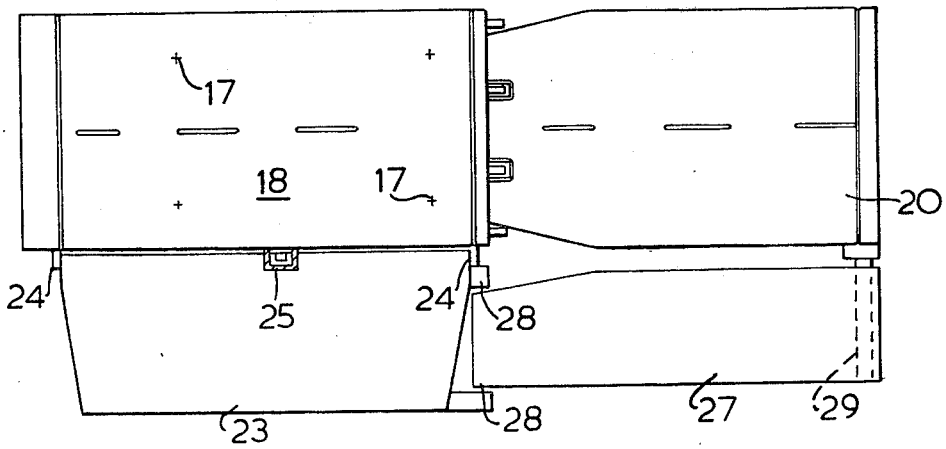

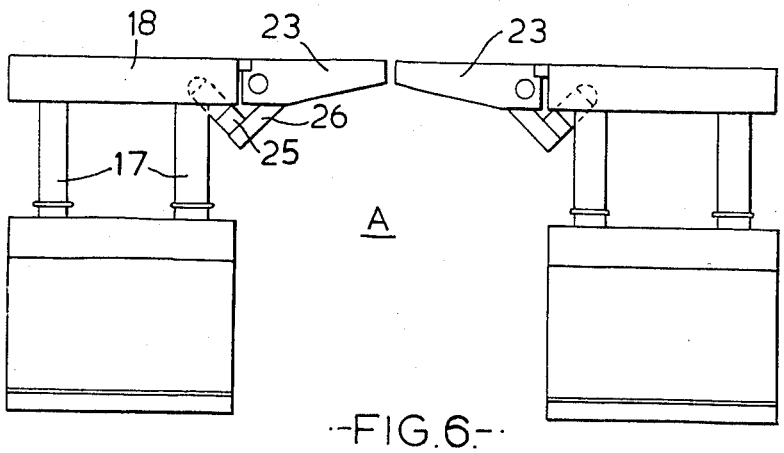
-FIG.6-
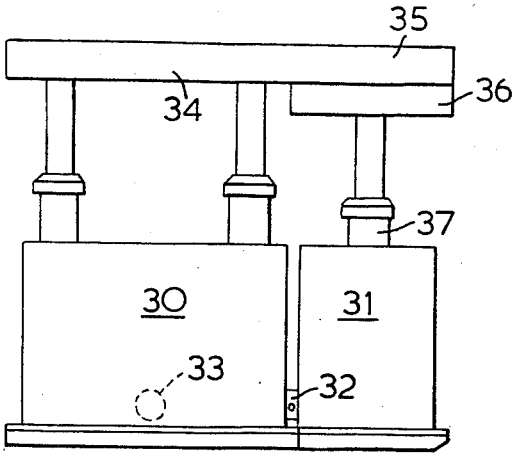
-FIG.7-
-FIG.8-
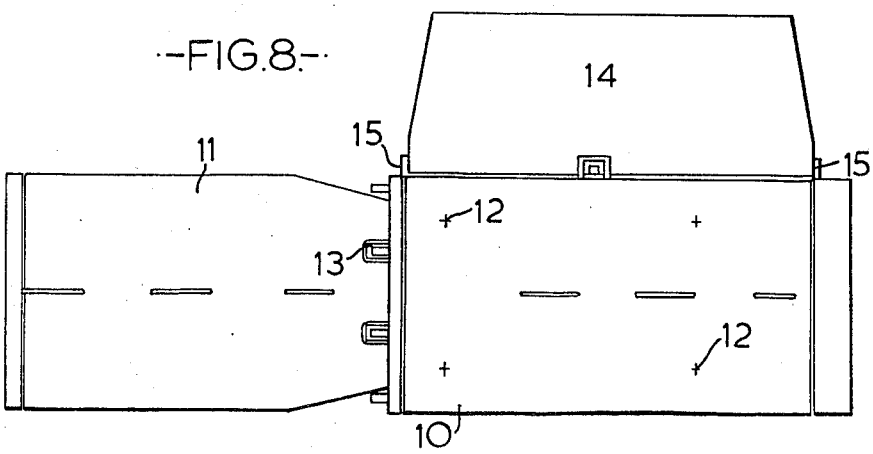

MINE ROOF SUPPORTS

The present invention relates to improvements in self-advancing mine roof supports of the known general type comprising a base structure and a roof-engaging structure extending over such support structure and supported therefrom by hydraulically extensible props.

Such known supports are commonly used in side-by-side relation in a row extending across a longwall face to form a substantially continuous support for the roof adjacent the face. When it is desired to provide ready access for materials, equipment and personnel to and from the longwall face through the row of supports one, at least, of such supports has to be withdrawn from the row to leave a gap in the row providing such access. The withdrawal of such support leaves the mine roof above the gap unsupported and thus potentially unsafe in an area where safety is of prime importance to protect personnel and valuable equipment.

It is the object of the present invention to overcome this draw back and to this end it is proposed that a roof support of the known kind referred to above should include, in its roof-engaging structure a selectively positionable lateral extension structure by means of which the effective roof supporting width of the roof-engaging structure may be laterally extended, so that when a support is withdrawn from a row of supports to create a gap in the row, the extension structures of the two supports on either side of the gap may be positioned to engage the roof above the gap and thus support the roof in this important area.

The lateral extension structures may be hinged along one or both side edges of each support used at a junction or intersection of a longwall face and a road or gate and positioned by means of hydraulic jacks so as to extend cantilever fashion laterally from the canopy of such supports.

Where the support has a forwardly or rearwardly extending cantilever extension of the canopy the lateral extension structure may include a section extending alongside the forward or rearward cantilever extension of the canopy.

Alternatively the lateral extension structure, instead of being hinged to the canopy, may be itself supported from a part of the base structure of the support, which part is displaceable laterally of the main part of the support to position the lateral extension structure either alongside or underneath the canopy.

Figure 1:
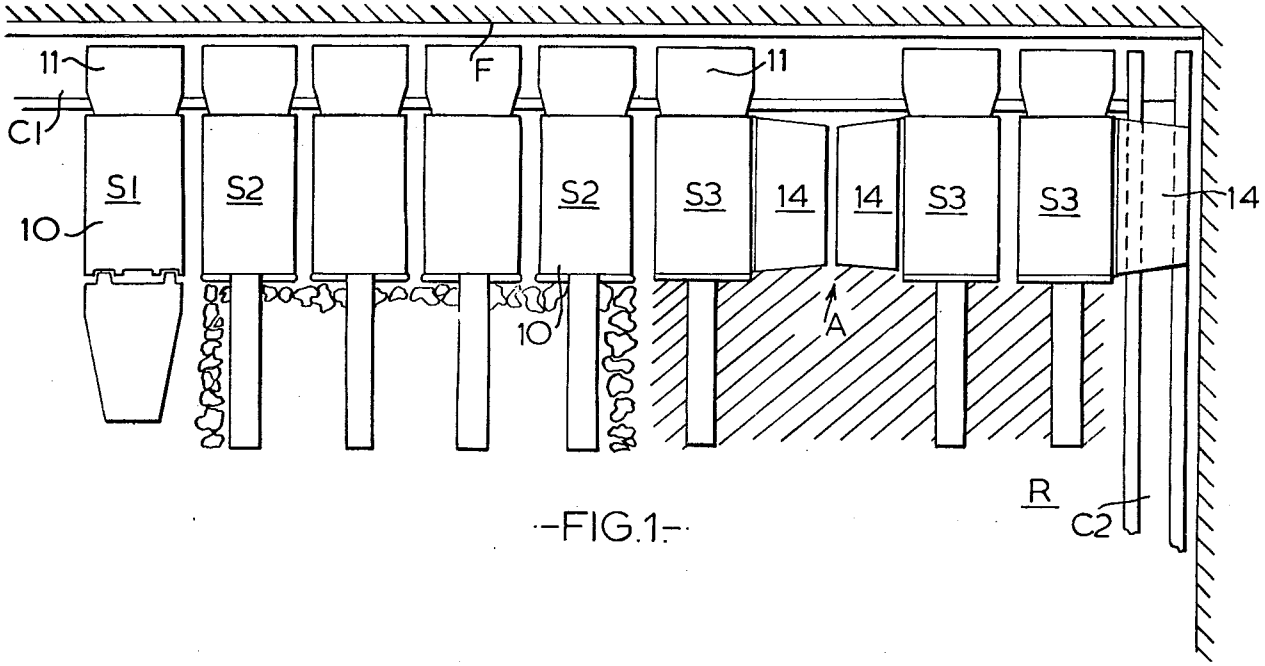
Figure 2:
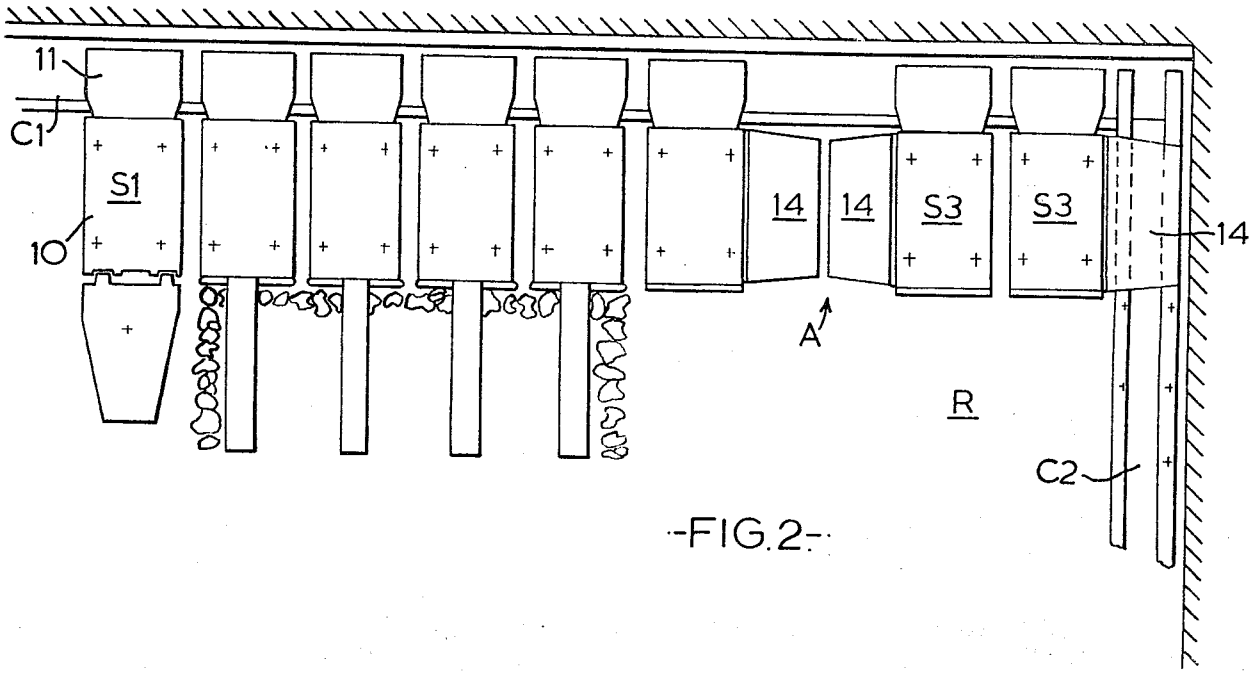

The invention will now be further described by way of example, with reference to the accompanying drawings in which:

FIG. 1 is a diagrammatic plan view of a mine working at the intersection or junction region of a longwall face and roadway before opening-up of the roadway, FIG. 2 is a diagrammatic plan view similar to FIG. 1 but after opening-up of the roadway, FIG. 3 is a plan view of one form of self-advancing roof support designed for the purpose of the invention, FIG. 4 is a side elevation of a further form of roof support suitable for the purpose of the invention, FIG. 5 is a plan view of FIG. 6, FIG. 6 shows two of the supports shown in FIGS. 4 and 5 arranged side-by-side so as to provide an unobstructed roof supporting "arch" which gives passage to and from the longwall face, and FIGS. 7 and 8 are side elevations of a further embodiment of the invention.

Referring first to FIG. 1, F indicates the longwall face and R the roadway. Self-advancing roof supports S1 are arranged along the face in the usual way. Towards the end of the face packhole supports S2 are provided. The supports S1 and S2 have a roof-engaging structure which includes a canopy 10 and a cantilever member 11, hingedly attached to said canopy, which extends over the face conveyor C1.

A further conveyor C2 is provided in the roadway R.

At the intersection or junction region or area of the longwall face F and the roadway R self-advancing supports S3 in accordance with the invention are provided.

One of the supports S3 is shown in some detail in FIG. 3. It comprises the canopy 10 which is mounted on hydraulically extensible props or legs 12, and the cantilever member 11 which is hingedly attached to the canopy 10 at 13. It will be noted that the cantilever 11 is pivoted on an axis transverse to the general direction of advance of the support. The cantilever member 11 may be applied to the roof by a further hydraulically extensible prop (not shown) or by a hydraulic jack which acts between the cantilever member and the canopy or some other part of the support. The arrangement may, for example, be as described in the Specification of our German Patent Application No. P14,08,709.2.

For the purpose of the present invention a further and laterally projecting roof-engaging cantilever member 14 is pivotally attached to the canopy 10 at 15. It will be noted that the cantilever member 14 is pivoted on an axis which extends in the general direction of advance of the support. The member 14 is conveniently applied to the roof by a hydraulic jack acting between the canopy and said laterally projecting cantilever member.

Referring now to FIGS. 1 and 2 it will be noted that the cantilever members 14 of two supports arranged side-by-side will provide a convenient and unobstructed roof supporting archway A for the passage of materials, equipment and personnel to and from the face F. Similarly the laterally projecting cantilever member of one such support will provide roof support over the roadway conveyor as indicated on the right-hand side of FIGS. 1 and 2.

The roof support shown in FIGS. 4 and 5 comprises a base 16 having mounted on it four hydraulically extensible props 17 which support a roof-engaging canopy 18. A double-acting hydraulic ram is provided in the base 16 of the support and is connected to the face conveyor C1 by a relay or extension bar 19. By this arrangement the ram acts to advance the conveyor, as mining of the mineral from the face proceeds, and then advances the support towards the conveyor in the well known way.

A cantilever roof-engaging member 20 is pivotally attached to the canopy 18 at 21 and is applied to the roof by a hydraulic jack 22 connected between the cantilever member 20 and the canopy 18.

For the purpose of the present invention a laterally projecting cantilever member 23 (equivalent to the member 14 of FIGS. 1, 2 and 3) is hingedly attached to the canopy 18 at 24. The canopy 23 (see FIG. 6) is applied to the roof by a hydraulic jack 25 connected between an arm 26 on the canopy 23 and the canopy 18.

The laterally projecting canopy 23 is provided with a forwardly projecting cantilever member 27 pivotally attached to it at 28 and the forward end of which rests on a bracket or like member 29 projecting laterally from the forward end of the canopy 20.

It will be noted from FIG. 6 that when two of the roof supports just described are arranged side-by-side, with their canopies 23 adjacent to one another, an unobstructed roof supporting archway A is provided for safe and free passage between the roadway and the longwall face.

The roof support shown in FIGS. 7 and 8 comprises a main unit 30 and a unit 31 positioned laterally with respect to the unit 30. The two units are coupled together by a double-acting hydraulic ram 32 having its axis transverse to the axis of the support advancing ram 33. The canopy 34 of the unit 30 has a laterally projecting roof-engaging extension 35. When a clear passage between the mineral face and the roadway is required the roof-engaging member 36 of the unit 31 is temporarily withdrawn from the roof and said unit is then brought up to the unit 30 by the ram 32. The hydraulic prop 37 of the unit 31 is then extended so as to apply the roof-engaging member 36 to the underside of the member 35 so as to give additional support to the latter. Two or more supports as just described may be arranged after the manner of the supports S3 shown in FIG. 1.

We claim:

1. A self-advancing mine roof support comprising a base structure and a roof-engaging structure extending over said base structure and supported therefrom by hydraulically extensible props, said roof-engaging structure including selectively positionable lateral extension structure means for laterally extending the effective roof-supporting width of the roof-engaging structure in a direction transverse to its direction of advance, and ram means connected to said lateral extension structure means from the remainder of the support for applying force to said lateral extension structure means upwardly towards a mine roof to be supported thereby.

2. A mine roof support according to claim 1, wherein said lateral extension structure means is pivotally attached to the main canopy of the roof-engaging structure along one side edge thereof that is substantially parallel to the direction of advance of the support.

3. A mine roof support according to claim 1, wherein said lateral extension structure means comprises two lateral extension structures respectively pivotally attached to the main canopy along opposite side edges thereof that are substantially parallel to the direction of advance of the support.

4. A mine roof support according to claim 1 wherein the roof-engaging structure comprises a canopy extending over said base structure and a cantilever extension of said canopy projecting forwardly or rearwardly of said canopy, said lateral extension structure means comprising a first extension member extending along one side edge of said canopy and a further extension member extending along one side edge of said cantilever extension.

5. A mine roof support according to claim 4 wherein said further extension member extends cantilever fashion from said first extension member.

6. A mine roof support according to claim 1 wherein the lateral extension structure means is supported from a part of said base structure which is displaceable laterally of said support to position said extension structure.

7. A mine roof support according to claim 6 wherein said lateral extension structure means is positionable under the canopy of said roof-engaging structure.

8. A mine roof support according to claim 1 wherein said ram means comprises a hydraulic jack or prop.

9. A mine roof support according to claim 1 characterized in that said lateral extension structure is of a size to extend the effective width of said roof-engaging structure by approximately one half.

* * * * *